United States Patent [19]

Hayek

[11] Patent Number: 4,770,165

[45] Date of Patent: Sep. 13, 1988

[54] VENTILATORS AND PRESSURE OSCILLATORS THEREOF

[76] Inventor: Zamir Hayek, 66 Shalva Street, Herzlia, Israel

[21] Appl. No.: 821,041

[22] Filed: Jan. 22, 1986

[30] Foreign Application Priority Data

Jan. 22, 1985 [GB] United Kingdom ..... 8501600

[51] Int. Cl.[4] ..... A61H 31/02

[52] U.S. Cl. ..... 128/30; 128/202.12; 128/205.26

[58] Field of Search ..... 128/205.18, 205.13, 128/202.12, 205.26, 30, 30.2

[56] References Cited

U.S. PATENT DOCUMENTS

| | | | |
|---|---|---|---|
| 2,223,570 | 12/1940 | McMillin | 128/30.2 |
| 2,314,955 | 3/1943 | Slater | 128/30 |
| 2,780,222 | 2/1957 | Polzin et al. | 128/30.2 |
| 3,903,869 | 9/1975 | Bancalari | 128/202.12 |
| 4,257,407 | 3/1981 | Macchi | 128/30.2 |
| 4,481,938 | 11/1984 | Lindley | 128/205.26 |

OTHER PUBLICATIONS

"A Nonpulmonary Complication of High-Frequency Oscillation", Critical Care Medicine—vol. 14, No. 3.

"Interstitial Pressure of the Lung" by R. Mellins, O. Levine, R. Skalak, A. Fishman, pp. 197-212.

Critical Care—vol. 6, pp. 1-6, 1985.

"Mechanical Forces Producing Pulmonary Edema in Acute Asthma" The New England Journal of Medicine, 9/15/77, pp. 592-597.

"External High Frequency Oscillation in Cats"—Respiratory Disease—vol. 133, No. 4, Apr. 1986, pp. 630-634.

Critical Care Medicine—1987 Yearbook—Chpt. 4—"-Ventilation Methods" pp. 193-205.

"Comparison of the Effects of Continuous Negative External Chest Pressure and Positive End-Expiratory Pressure on Cardiac Index in Dogs" American Review of Respiratory Disease, vol. 115, 1977.

"The Cardiovascular Effects of Positive End-Expiratory Pressure" by Robert Pick, J. Handler & A. Friedman.

"Prolonged Endotracheal Intubation vs. Tracheostomy"—Critical Care Medicine—vol. 14, No. 8.

"Acute Lesions Induced by Endotracheal Intubation'-'—Amer J Dis Child/vol. 124, Nov. 1972.

"Gas Transport During Different Modes of High-Frequency Ventilation" Critical Care Medicine—vol. 14, No. 1, pp. 5-11.

"Mechanisms Affecting Gas Transport During High--Frequency Oscillation"—Critical Care Medicine—-vol. 12, No. 9, pp. 713-717.

"Comparison of High-Frequency Chest Wall Compresson with Conventional Mechanical Ventilation in Cats'-'—Critical Care Medicine—vol. 15, No. 7, pp. 676-681.

Smith; R. B., Ventilation At High Respiratory Frequencies; 1982.

*Primary Examiner*—Edward M. Coven
*Assistant Examiner*—J. P. Lacyk
*Attorney, Agent, or Firm*—Cushman, Darby & Cushman

[57] ABSTRACT

A ventilator for producing artificial respiration comprising a pressure chamber for receiving at least the chest of a patient so as to establish a volume exterior of the chest between which volume and the lungs of the patient a pressure differential may be produced by pressure changes applied to said chamber, means a vacuum source for establishing a sub-ambient pressure in said chamber, and an oscillating pressure source for varying the pressure in said chamber so as to superimpose on said sub-ambient pressure a cyclic variation having a frequency of above 1 Hz.

22 Claims, 2 Drawing Sheets

VENTILATORS AND PRESSURE OSCILLATORS THEREOF

FIELD OF THE INVENTION

The present invention relates to ventilators for the artificial or assisted respiration of patients, and to pressure oscillators being components of such ventilators.

BACKGROUND OF THE INVENTION

Adult and pediatric patients who are maintained by a regime of positive pressure ventilation are likely to develop various complicating conditions related to the use of this type of ventilation. These include barotrauma of various kinds such as pneumothorax, pneumomediastinum, pneumopericardium, pneumoperitoneum, subcutaneous emphysema and air embolization.

The act of intubation itself presents hazards in ventilation including disconnection, inadvertent extubation, tracheal trauma, infection, tube blockage, vocal cord dysfunction and subglottic stenosis. Intubation also is a highly skilled procedure.

Negative pressure ventilators of the "iron lung" and "iron cuirass" type) for adult patients and children have long been available and were the first type of ventilators to be developed. These functioned well for patients such as those affected by poliomyelitis and other neuromuscular disorders where the lungs are essentially healthy but their function is disrupted by impairment of neurologic function, muscle contraction etc. They were much less successful in conditions such as adult respiratory distress syndrome (ARDS) where the lungs themselves contain the primary defects including reductions in pulmonary compliance and increased airway resistance. They have accordingly very largely fallen out of use in favour of a variety of positive pressure ventilation regimes despite the problems attendant upon the use of positive pressure.

Generally, such negative pressure ventilators operate at a low frequency such as 10 to 20 breathing cycles per minute. In the negative pressure cuirass type ventilator described in U.S. Pat. No. 3,078,842, a pressure alternator provides pressure variations at a frequency of 10 to 20 per minute to produce ventilation, whilst a second pressure alternator superimposes periodically a very high pressure at a higher frequency (60 to 120 pulses per minute) to produce cardiac massage. This device is intended for resuscitation from pulmonary and cardiac arrest and not for prolonged ventilation. The high frequency, high pressure aspect of the treatment is to stimulate the heart and is not suitable in itself to produce ventilation.

Particular difficulties arise in the ventilation of neonate and preterm babies.

Neonate and preterm babies with respiratory failure develop hypoxia, and metabolic and respiratory acidosis that may lead to their death if untreated by assistant ventilation.

At present, neonates needing to be ventilated are generally intubated and respiration is then forced by positive pressure applied to the lung through the intubation. This procedure carries with it a serious risk of barotrauma as described above, in particular, pneumothorax, pneumomediastinum, interstitial emphysema, or bronchopulmonary displasia (BPD). A very high proportion of babies ventilated by this method, known as intermittent positive pressure ventilation (IPPV), will develop BPD caused directly by this procedure. There is also a danger of causing laryngial and tracheal complications and of introducing infection into the lung.

As many as fifteen percent of babies ventilated by IPPV have the complication of interstitial emphysema which carries a high mortality rate.

The IPPV procedure has however been found preferable in many circumstances to the use of ventilators of the kind described for instance in U.S. Pat. No. 2863447 which is a negative pressure ventilator having an incubator forming a pressure chamber divided into two compartments by a flexible seal. The head of the infant is contained in one compartment and the body in the other and the seal makes a substantially gas tight seal about the infant's neck. It is then possible to produce a cyclic variation of pressure in the body compartment and optionally also the head compartment. Partial evacuation of the body compartment with or without simultaneous increase of pressure in the head compartment causes expansion of the lungs and release of air into the body compartment allows the lungs to expel air. Generally, such negative pressure ventilators operate at a rate of from 20 to 60 cycles per minute.

Such negative pressure ventilators have been found to have several severe drawbacks some of which relate to the structure of the incubator.

First, it is almost impossible to use such ventilators to ventilate babies having a weight of less than 1.5 kilograms. The pressure differential between the atmosphere surrounding the head and the interior of the body compartment produces forces trying to suck the baby's head through the flexible seal and this imposes an excessive strain on the baby's neck in the case of very small babies.

Secondly, the patient is inaccessible for routine or emergency procedures. Being entirely contained within the ventilator which must be kept closed if ventilation is to continue, the patient is wholly inaccessible. For installing or maintaining drips or arterial lines and even for simple operations such as cleaning and nappy changing, the ventilator must be opened and the patient must be intubated.

Thirdly, the operation of the ventilator produces a constant flow of air into and out of the body cavity of the ventilator which produces a cooling effect which is difficult to counteract. Very small babies are of course very prone to suffer severe heat loss.

Negative pressure ventilators of this kind proposed in the past are relatively expensive because they involve an entire incubator.

Most seriously however, negative pressure ventilators of previously known designs do not provide maintain clinical parameters at acceptable values in actual use in treating patients with lung disorders and they have not found clinical acceptance. Despite the known problems, IPPV techniques are still the mainstay of clinical practice in this field.

U.S. Pat. No. 3,903,869, (Bancalari) discloses a continuous negative pressure chamber for treating infants with ideopathic respiratory distress syndrome (IRDS). The chamber receives the trunk of an infant, seals being provided at the neck and abdomen.

The chamber of U.S. Pat. No. 3,903,869 is not in fact intended to produce forced respiration but rather to assist spontaneous breathing. In some embodiments, it provides a constant negative pressure to prevent lung collapse. In the embodiment described with reference to FIG. 4, provision is made for increasing negative pressure cyclically at up to 30 to 40 cycles per minute to induce spontaneous breathing by stirring the infant out of apnea.

Whilst both positive pressure and negative pressure ventilation have traditionally operated at frequencies similar to those of natural breathing, more recently techniques of high frequency positive pressure ventilation (HFPPV) have been proposed, although not widely accepted. In such methods, ventilation is conducted at above 1 Hz. It was hoped that the small tidal volumes and generally lower airway pressures developed by high frequency ventilators would be associated with a lower incidence of complications, but experience has not borne this out. Interest in this technique was widespread for a brief period but is now decreased.

Little is known about the mechanisms by which oxygenation and ventilation occur during HFPPV although a number of plausible theories have been proposed.

Some experimental work on healthy animals and healthy animal lung tissue has been conducted using brief periods of external high frequency ventilation, but until now there has been no demonstration of a technique of this type capable of providing satisfactory ventilation for prolonged periods of healthy lungs nor of a sick lung.

Ward et al (J. Appl. Physiol: Respirat. Environ. Exercise Physiol. 54 (2): 427–433, 1983) applied external high frequency oscillatory ventilation to isolated, perfused rat lung and concluded that satisfactory oxygen uptake could be maintained by this method.

Hart et al (J. Appl. Physiol: Respirat. Environ. Exercise Physiol. 56 (1): 155–160, 1984) compared external and internal (tracheal) high frequency ventilation for five minutes in rats with normal lungs and found them equally effective.

In the development of the present invention however, it has been found that in the Application of the method employed by Hart et al to cats with normal lungs, there was severe progressive fall in functional residual capacity (FRC) which produced also a reduction in blood oxygen tension. Cats whose lungs have been rendered stiff by lavage with saline as a model of sick lung could not be successfully ventilated in this way nor even cats with normal lungs for a period more than a few minutes.

BRIEF DESCRIPTION OF THE INVENTION

The present invention seeks to overcome the problems described above by providing methods and apparatus suitable for the satisfactory external ventilation of sick lungs, thus avoiding the complications associated with positive pressure ventilating systems.

It has been discovered that in an external high frequency ventilator, the use of a negative base line chamber pressure provides strikingly improved results. Further, it has been found that improved results also follow from the use of pumped displacement of gas into the chamber surrounding the chest during the pressurerise part of the cycle rather than relying on release of air into the chamber from atmosphere.

Accordingly, the present invention provides a ventilator for producing artificial respiration comprising a pressure chamber for receiving at least the chest of a patient so as to establish a volume exterior of the chest between which volume and the lungs of the patient a pressure differential may be produced by pressure changes applied to said chamber, means for varying the pressure in said chamber, means for establishing a sub-ambient pressure in said chamber, and means for varying the pressure in said chamber, so as to superimpose on said sub-ambient pressure a cyclic variation having a frequency of above 1 Hz.

Preferably, the means for establishing a sub-ambient pressure in said chamber is adapted to produce a negative pressure of at least 196 Pa (2 cm $H_2O$), e.g. from 196 Pa to 2940 Pa (30 cm $H_2O$) more preferably from 196 Pa (2 cm $H_2O$) to 1961 Pa (20 cm $H_2O$).

Preferably, the means for establishing a sub-ambient pressure in said chamber is adjustable to provide a desired sub-ambient pressure and as the most preferred mean chamber pressure is about −980 Pa (−10 cm $H_2O$), preferably at least a range of from −490 Pa (5 cm $H_2O$) to −1470 Pa (15 cm $H_2O$) is available.

Preferably, the means for varying the pressure in the chamber is adapted to produce a pressure variation amplitude of from 392 Pa (4 cm $H_2O$) to 3136 (32 cm $H_2O$).

Preferably, the means for varying the pressure in the chamber is adjustable to produce a desired amplitude of pressure variation such as from 785 Pa (8 cm $H_2O$) to 1570 Pa (16 cm $H_2O$).

Preferably, the means for varying the pressure in the chamber is adjustable to provide a desired shape of waveform for said cyclic pressure variation. It may for instance be possible to vary the I/E ratio, to choose between two or more of a sine wave pattern, a square wave pattern or a saw tooth wave pattern for the whole of the pressure variation, or for parts of the wave form or to choose other wave forms.

It may be convenient for said means for establishing a sub-ambient pressure in said chamber, and means for varying the pressure in said chamber so as to superimpose on said sub-ambient pressure a cyclic variation having a frequency of above 1 Hz to be provided in combination by a pump unit.

Preferably, said pump unit comprises a piston member for driving a volume of air cyclicly into and out said chamber to produce said pressure variation, and valve means positioned and adapted to vent a proportion of the air displaced by said piston member out of the ventilator to establish said sub-ambient pressure in the chamber.

Said piston member may be a flexible diaphragm secured around an edge region thereof to close a pump chamber and having a central region which is reciprocable to pump air to and from pump chamber, said pump chamber communicating with said pressure chamber.

Said valve means may be a non-return valve allowing limited air flow out of said pressure chamber.

Preferably, said means for varying the pressure in said chamber comprises a motor operating a pump unit, which motor is a variable speed motor.

Preferably, said variable speed motor is a stepping motor. By feeding suitable patterns of stepping pulses to the motor, any desired waveform of pressure variation may then be obtained and both shape and frequency of the waveform may be varied at will.

Preferably, said piston member is reciprocable along a first axis, a motor is provided having an output shaft rotating about a second axis parallel to the first axis, a radius member is provided extending radially of the output shaft and connected to rotate therewith about the first axis, and a link is provided between the piston member and the radius member.

Suitably, the means for varying the pressure in the chamber is adapted to produce cyclic variations in said pressure at a frequency of from 3 to 12 Hz.

The frequencies most advantageously used are from 4 to 8 Hz, e.g. about 5 Hz.

Preferably, the pressure chamber has a pair of opposed wall portions mutually spaced by an amount suitable to accommodate between them the chest portion of the trunk of an infant and means defining an inlet and outlet for gas to and from said chamber, each said wall portion containing an aperture for receiving a portion of the trunk of the infant, and means being associated with each such aperture for producing an at least substantially gas tight seal between the respective wall portion and the patient's trunk in use.

A patient may be placed in such a ventilator so that the ventilator extends only from the axilla at the one end to the lower abdomen or pelvis at the other, so that only the chest and abdomen are inside the chamber. This avoids the strain upon the neck encountered in small infants when using a conventional negative pressure ventilator. Cyclic pressure changes may be induced in the chamber through the gas inlet and outlet in a manner similar to that employed in conventional negative pressure ventilators.

The ventilator may comprise means defining a separate inlet for gas to the chamber and a separate outlet for gas from the chamber but it is preferred that the pressure oscillations be produced by pumping gas in and out of the chamber alternately through a common flow path.

Preferably, the chamber is provided with an access door intermediate said opposed wall portions by means of which a patient may be inserted into the chamber. Alternatively however, the patient may be inserted through the apertures in the opposed wall portions.

Preferably the means for producing a seal to the trunk each comprise a variable aperture diaphragm. This may for instance be of the kind described in U.S. Pat. No. 2863447 or of any other kind heretofore used in negative pressure ventilators for a similar purpose.

The present invention includes a method of assisted respiration of a patient e.g. an infant patient, comprising producing between the chest of the patient and the trachea of the patient a cyclicly varying pressure differential at a frequency of at least 1 Hz, more preferably from 3 to 12 Hz, for instance 4 to 8 Hz, about a negative mean by varying the pressure outside the chest of the patient.

The present invention also includes a method of assisted ventilation of a patient comprising placing at least the trunk of a patient within the chamber of a ventilator as described herein, and applying said cyclic pressure changes to the said chamber to assist respiration.

The invention includes an oscillator unit for producing cyclic pressure variations about a sub-ambient base line pressure comprising means for establishing a gas flow connection from the oscillator to an incubator chamber, means for pumping air from an incubator chamber to produce a negative pressure therein, and means for pumping air to and from said incubator chamber cyclically at a frequency of at least 1 Hz.

Whilst the preferred means of producing cyclic pressure changes in the chamber of a ventilator as described above is to attach to the gas connection or connections thereof a source of varying gas pressure operating to produce pressure changes in the chamber by inflow and outflow of gas, alternative means of producing pressure changes in a chamber of a ventilator are available and may be used.

Such a means for producing cyclic variation may for instance be a flexible wall member defining the chamber volume together with means for moving the flexible wall member between positions in which the volume of the chamber if greater and lesser respectively. By such a mechanism, the cyclic inflow and outflow of gas from the chamber can be avoided. A base line negative pressure may be provided by a constant source of vacuum such as a constant speed vacuum pump.

BRIEF DESCRIPTION OF THE DRAWINGS

The invention will be illustrated by the following description of a preferred embodiment thereof with reference to the accompanying drawing which.

DETAILED DESCRIPTION OF PREFERRED EMBODIMENTS

Figure 1:
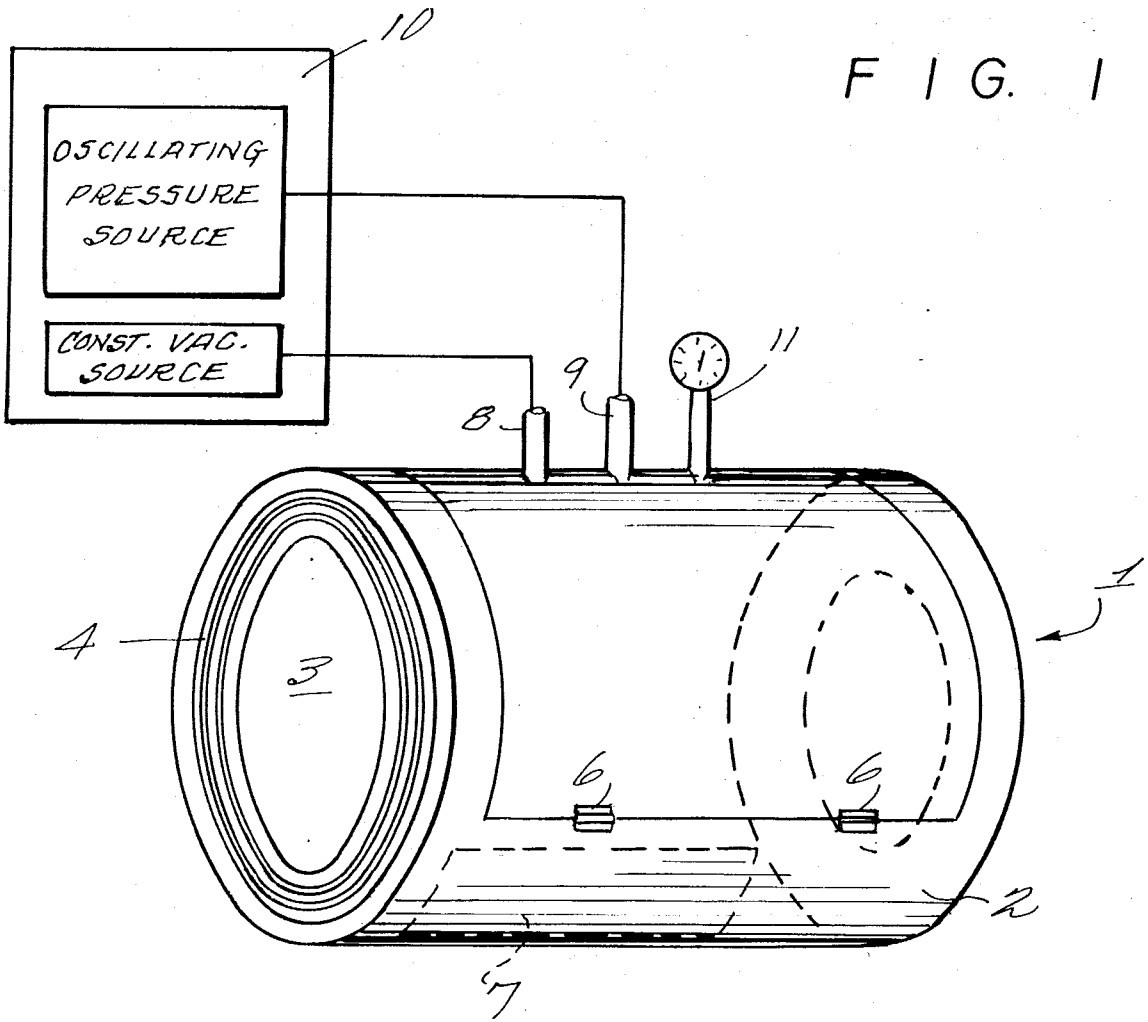
FIG. 1 shows in schematic perspective view a ventilator according to the invention.

As shown in FIG. 1, ventilating apparatus 1 comprises a chamber 2 in the form of a cylindrical chamber having at each end an aperture 3 defined by a radially expansible diaphragm 4.

An access door 5 is mounted on hinges 6 and opens about a hinge axis extending parallel to the axis of the cylinder. The door is provided with a suitable latch means for retaining it closed and with suitable seals about its periphery to maintain the chamber sealed when the door is shut. A pillow as shown at 7 may be positioned within the ventilator to support the trunk of an infant patient.

The chamber is provided with two gas connections 8, 9 for connection to an oscillating pressure source schematically indicated at 10. A pressure gauge 11 is provided to enable monitoring of the gas pressures in the chamber.

The entire chamber 2 can be placed within a conventional incubator and the oscillating pressure source can be arranged to draw and exhaust its air used for pressurising and depressurising the chamber 2 from the interior of the incubator. By this means, the severe cooling effects found in using negative pressure ventilators in the past may be avoided.

If desired, the distance between the two diaphragms 4 may be made adjustable to enable different sizes of infants to be accommodated. However, this will not generally be necessary. The leftmost diaphragm is intended to be located around the axilla of the infant patient and the rightmost diaphragm may be located at any position between the lower end of the rib cage and the pelvis.

One suitable method of producing the expansible diaphragm 4 is described in U.S. Pat. No. 2863447. Such a diaphragm comprises a pair of mutually rotatable circular rim members spaced by a short distance along the axis of the cylinder 1. A soft flexible tube of plastics or rubber material is connected at one end to a first of the rim members and at the other end to a second of the rim members. The rim members are mounted in a mutually rotatable manner. Rotation of the rim members with respect to one another produces folds and pleats in the soft tube which constrict the diameter of the tube and form a flexible and comfortable seal about the body of the infant occupying the chamber. A seal of this type may be used at each end of the ventilator.

The oscillating pressure source 10 may comprise a source of constant negative pressure connected to gas connection 8 of the chamber whereby a background negative pressure is established in the chamber at a desired level together with a source of oscillating pressure such as a piston pump adapted to pump a constant volume of gas backwards and forwards into and out of the chamber connected through the other connection 9 of the chamber.

Preferably, both the source of constant negative pressure connected at connection 8 and the oscillating pressure source connected at connection 9 are adjustable so that the mean chamber pressure, the span of the pressure variation about the mean and the frequency are all selectable by the user.

Figure 2:
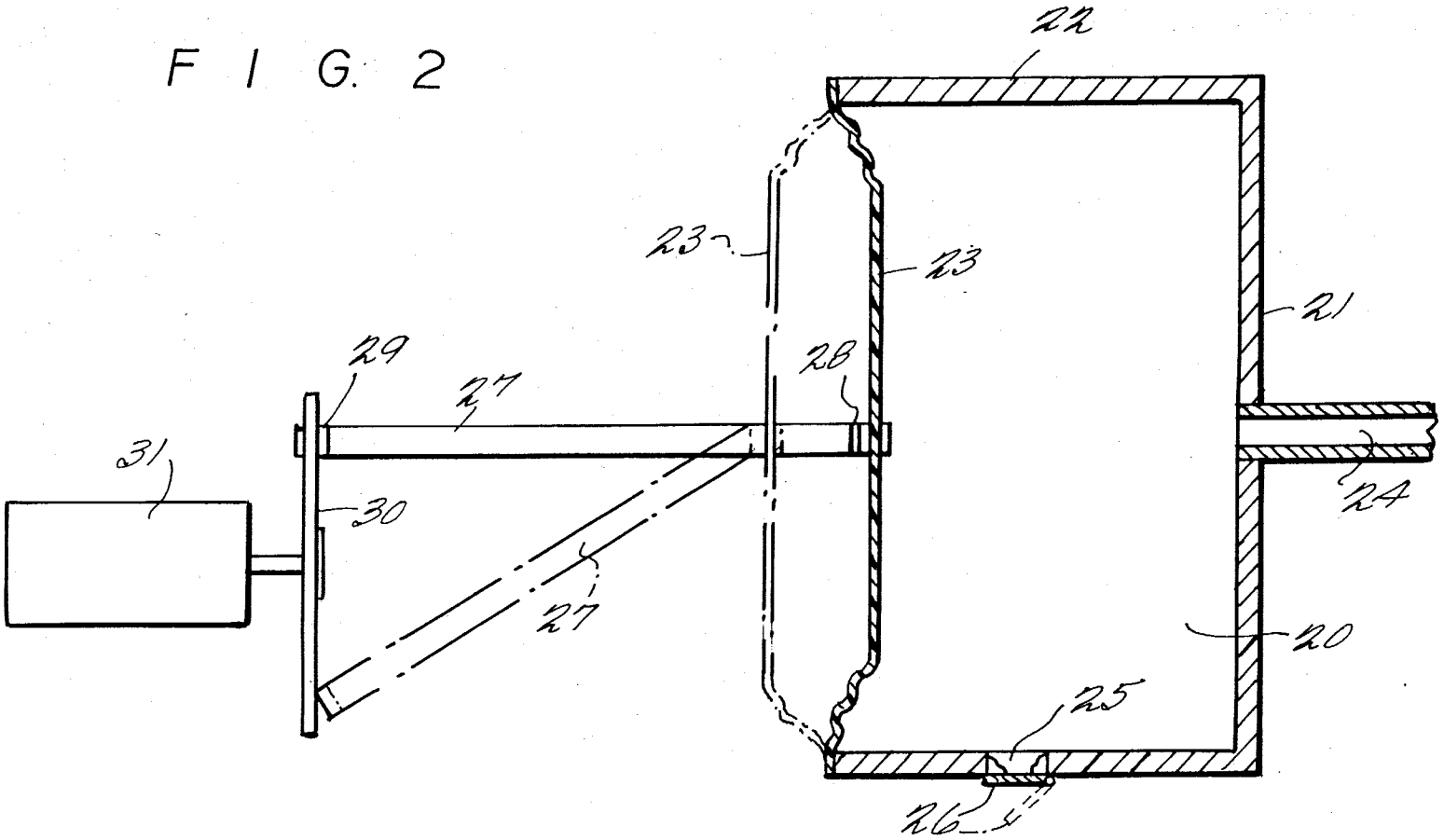
FIG. 2 shows schematically an alternative oscillating pressure source for use with the chamber of FIG. 1.

An alternative form of oscillating pressure source is shown in FIG. 2. This is adapted to produce through a single connection both a negative mean chamber pressure and the required oscillation of the pressure. Accordingly, in using the oscillating pressure source of FIG. 2, one of the connections 8, 9 of the chamber will be blanked off.

The oscillating pressure source shown in FIG. 2 comprises a pump unit comprising a pressure chamber 20 having a front wall 21 and an annular side wall 22 with a flexible diaphragm 23 closing the rear of the pressure chamber to define a generally cylindrical volume within the pressure chamber which is variable by axial displacement of the diaphragm 23. A gas outlet 24 is provided in the front wall 21 for connection to the chamber.

A valve port 25 is formed in the annular wall 22 and is covered by a valve flap 26 hinged for outward movement to the position shown dotted. Valve flap 26 is resiliently biased to the closed position by means not shown. Suitably, the biasing of flap 26 is simply by virtue of its own natural resilience.

A link shaft 27 is connected to the centre of diaphragm 23 by a universal joint 28. At its other end, link shaft 27 is connected through a universal joint 29 to an eccentric position on a disc 30 which is mounted for rotation by a stepping motor 31 at its axis. Disc 30 serves as a radius member mounting one end of link 27 for rotation eccentrically about the axis of the motor 31.

As shown in the figure, the diaphragm 23 is axially displaceable by rotation of the disc 30 by the motor 31. The position adopted by the diaphragm and the link 27 at an opposite extreme part of the rotational cycle is shown by dotted lines in the figure.

Rotation of the motor 31 produces reciprocating movement of the diaphragm 23 acting as a piston member to displace gas backwards and forwards through the connection 24.

As the diaphragm 23 moves to compress in the pressure chamber 20 and to displace gas out of the connection 24, the valve flap 26 opens and some gas is lost from the pressure chamber 20 through the valve port 25. Valve flap 26 closes to prevent re-entry of gas from the exterior when the diaphragm 23 is withdrawn by the motor 31. Thus, although gas is pumped to and fro through connection 24, some gas is continuously lost from the system generating a negative base line pressure. Of course, gas also enters the chamber through any leak present in the seals so mitigating the negative pressure produced by the action of the valve 25, 26.

The motor 31 is a stepping motor and is driven by the provision of suitable stepping pulses. These may be produced by suitable microprocessor circuitry and sequences of pulses may be sent to the motor to produce any desired variation in speed within a single revolution. Thus, the pressure wave form produced at the connection 24 may be closely controlled by the provision of suitable control circuitry and the user may be provided with the means to shape the wave form as he desires as well as to choose the frequency of the pressure oscillation, the mean chamber pressure and the span of the pressure changes.

It has been found that the regime of pressure changes and mean chamber pressure described above enable the ventilation of patients whose lungs are not healthy, for instance neonates with IRDS, whereas previous proposals for external high frequency ventilation have proved effective only in animals with healthy lungs in laboratory tests.

Compared to existing methods and apparatus for assisted ventilation the apparatus described above has substantial advantages. Intubation is avoided and with it all of the associated complications discussed above.

As compared to negative pressure ventilators of prior designs, the ventilator described with reference to the drawing is of low cost since it need not be formed integrally with an incubator but rather can be used within a conventional incubator.

The head, shoulders and arms and the lower part of the patient's body are left accessible for routine or emergency procedures. There is therefore no need to interfere with the process of ventilation to keep the infant clean and dry or to install or maintain drips or other lines.

Because it can be arranged that the air moving in and out of the ventilator is drawn from the incubator, the temperature of the infant can be controlled satisfactorily and this is made even easier by the fact that a substantial part of the patient's body is not involved in the ventilator but is simply in the atmosphere of the incubator.

Because there are two opposed diaphragms there is little or no tendency for the negative pressure to seek to draw the patient further into the chamber of the ventilator. Strain on the neck of very small babies is avoided as the seal of the ventilator is made around the axilla. However, even if one were to choose to make the upper seal around the patient's neck, there would be little or no strain imposed on the neck by the operation of the ventilator because of the use of two diaphragms.

Accordingly, babies may be ventilated using such a ventilator irrespective of their weight.

Whilst the invention has been described with particular reference to infant patients, methods and apparatus of the invention may be employed with adult patients also.

Whilst the invention has been described with reference to specific characteristics of the embodiment described, many modifications and variations thereof are possible within the scope of the invention.

I claim:

1. A ventilator for producing artificial respiration comprising a pressure chamber for receiving at least the chest of a patient so as to establish a volume exterior of the chest between which volume and the lungs of the patient a pressure differential may be produced by pressure changes applied to said pressure chamber, means for establishing a sub-ambient pressure in said pressure chamber, and means for varying the pressure in said pressure chamber so as to superimpose on said sub-ambient pressure a cyclic variation having a frequency of above 1 Hz.

2. A ventilator as claimed in claim 1, wherein the means for establishing a sub-ambient pressure in said pressure chamber is adapted to produce a pressure of from −196 Pa (2 cm $H_2O$) to −1961 Pa (20 cm $H_2O$).

3. A ventilator as claimed in claim 1, wherein the means for varying the pressure in the pressure chamber is adapted to produce a pressure variation amplitude of from 392 Pa (4 cm $H_2O$) to 3136 (32 cm $H_2O$).

4. A ventilator as claimed in claim 1, wherein the means for varying the pressure in the pressure chamber is adjustable to provide a desired shape of waveform for said cyclic pressure variation.

5. A ventilator as claimed in claim 1, wherein said means for establishing a sub-ambient pressure in said pressure chamber and means said for varying the pressure in said pressure chamber are provided in combination by a pump unit.

6. A ventilator as claimed in claim 5, wherein said pump unit comprises a piston member for driving a volume of air cyclicly into and out of said pressure chamber to produce said pressure variation, and valve means positioned and adapted to vent a portion of the air displaced by said piston member out of the ventilator to establish and maintain a sub-ambient baseline pressure in said pressure chamber.

7. A ventilator as claimed in claim 6, wherein said pump unit comprises a pump chamber which is coupled to said pressure chamber and whrein said piston member includes a flexible diaphragm having an edge region by which it is secured to close the pump chamber and having a central region which is reciprocable to increase and decrease the pressure in said pump chamber and said pressure chamber.

8. A ventilator as claimed in claim 1, wherein said means for varying the pressure in said pressure chamber comprises a motor operating a pump unit, which motor is a stepping motor.

9. A ventilator as claimed in any preceding claim, wherein the means for varying the pressure in the pressure chamber is adapted to produce cyclic variations in said pressure at a frequency of from 3 to 12 Hz.

10. A ventilator as claimed in claim 1, wherein the chamber has a pair of opposed wall portions mutually spaced by an amount suitable to accommodate between them the chest portion of the trunk of an infant, each said wall portion containing an aperture for receiving a portion of the trunk of the infant and means associated with each such aperture for producing an at least substantially gas tight seal between the respective wall portion and the patient's trunk in use, and means defining an inlet and an outlet for gas to and from said chamber.

11. An oscillator for producing cyclic pressure variations about a sub-ambient base line pressure comprising means for establishing at least one gas flow connection from the oscillator to a patient receiving pressure chamber, means for pumping air through said gas flow connection means from said pressure chamber so as to produce a sub-ambient pressure in said pressure chamber, and means for pumping air through said gas flow connection means to and from said pressure chamber cyclically at a frequency of at least 1 Hz.

12. An oscillator as claimed in claim 11 wherein said means for establishing a sub-ambient pressure in said pressure chamber, and means for varying the pressure in said pressure chamber are provided in combination by a pump unit.

13. An oscillator as claimed in claim 12, wherein said pump unit comprises a piston member for driving a volume of air cyclicly into and out of said chamber to produce said pressure variation, and valve means positioned and adapted to vent a portion of the air displaced by said piston member out of the ventilator to establish and maintain a sub-ambient baseline pressure in said chamber.

14. An oscillator as claimed in claim 13, wherein said pumping unit comprises a pump chamber which is coupled to said pressure chamber and wherein said piston member includes a flexible diaphragm having an edge region by which it is secured to close the pump chamber and having a central region which is reciprocable to increase and decrease the pressure in said pump chamber and said pressure chamber.

15. An oscillator as claimed in claim 14, wherein said valve means is a non-return valve allowing limited air flow out of said oscillator.

16. An oscillator as claimed in claim 11, wherein said means for pumping the air cyclically comprises a pump unit and a motor operating the pump unit, said motor being a variable speed motor.

17. An oscillator as claimed in claim 16, wherein said variable speed motor is a stepping motor.

18. An oscillator as claimed in claim 11, adapted to produce cyclic variations in pressure at a frequency of from 3 to 12 Hz.

19. A method for the assisted ventilation of a patient using a ventilator for producing artificial respiration including a patient receiving pressure chamber for receiving at least the chest of a patient so as to establish a volume exterior of the chest between which volume and the lungs of the patient a pressure differential may be produced by pressure changes applied to said pressure chamber, comprising the steps of:

placing at least the chest of the patient within said pressure chamber;

establishing a sub-ambient pressure in said pressure chamber, and varying the pressure in said pressure chamber so as to superimpose on said sub-ambient pressure a cyclic variation having a frequency of at least 1 Hz.

20. A method as claimed in claim 19 wherein said frequency is about 6 Hz.

21. A ventilator as claimed in claim 1 wherein said means for varying includes means for varying the I/E ratio of the ventilator.

22. An oscillator as claimed in claim 12 wherein said means for varying includes means for varying the I/E ratio of the oscillator.

* * * * *